US005338160A

United States Patent [19]

Thurner

[11] Patent Number: 5,338,160

[45] Date of Patent: Aug. 16, 1994

[54] INDIVIDUAL CONTROLLABLE CYLINDER-PLUNGER ASSEMBLIES OF A RADIAL PISTON PUMP

[75] Inventor: Jörg Thurner, Vienna, Austria

[73] Assignee: Gesellschaft für ökologische Ökomobil Technologie für Fahrzeuge GmbH, Austria

[21] Appl. No.: 53,182

[22] Filed: Apr. 26, 1993

Related U.S. Application Data

[63] Continuation of Ser. No. 838,299, Mar. 23, 1992, abandoned.

[30] Foreign Application Priority Data

Sep. 18, 1989 [AT] Austria ..... A2175/89

[51] Int. Cl.[5] ..... F04B 1/04; F04B 21/02

[52] U.S. Cl. ..... 417/273; 417/287; 417/446; 417/505; 137/523

[58] Field of Search ..... 417/286, 287, 273, 427, 417/446, 505; 137/522, 523

[56] References Cited

U.S. PATENT DOCUMENTS

| | | | |
|---|---|---|---|
| 1,636,258 | 7/1927 | Svartz | 417/273 |
| 2,586,902 | 2/1952 | Anderson | 417/446 |
| 3,119,550 | 1/1964 | West et al. | 417/286 |
| 3,421,546 | 1/1969 | Jennings et al. | 137/523 |
| 3,829,255 | 8/1974 | Bykov et al. | 417/446 |
| 4,008,011 | 2/1977 | Scherbakov et al. | 417/446 |
| 4,073,277 | 2/1978 | Eheim | 417/505 |
| 4,080,107 | 3/1978 | Ferrentino | 417/446 |
| 4,391,296 | 7/1982 | Abbott | 137/523 |
| 4,820,130 | 4/1989 | Eber et al. | 417/505 |
| 4,961,234 | 8/1989 | Joy et al. | 417/273 |

FOREIGN PATENT DOCUMENTS

| | | | |
|---|---|---|---|
| 2503319 | 10/1982 | France | 137/523 |
| 669704 | 4/1952 | United Kingdom | 417/446 |

*Primary Examiner*—Richard A. Bertsch
*Assistant Examiner*—Roland G. McAndrews, Jr.
*Attorney, Agent, or Firm*—Feiereisen & Kueffner

[57] ABSTRACT

A radial piston pump includes a plurality of radially arranged cylinder-plunger assemblies having suction valves and pressure-regulating valves, with the plungers being controlled by an eccentric disk which eccentrically circulates relative to a housing accommodating the cylinders. In order to provide a radial piston pump of this type with a simple design and to allow a digital operation of the pump for controlling the flow rate, the space between the end faces (12) of the cylinders (9) and the pertaining plungers (7) is connectable with a pressure manifold (19) of the pump by a randomly controllable valve (21, 22), with the plungers (9) of the pump preferably having different diameters.

8 Claims, 3 Drawing Sheets

Figure 1:
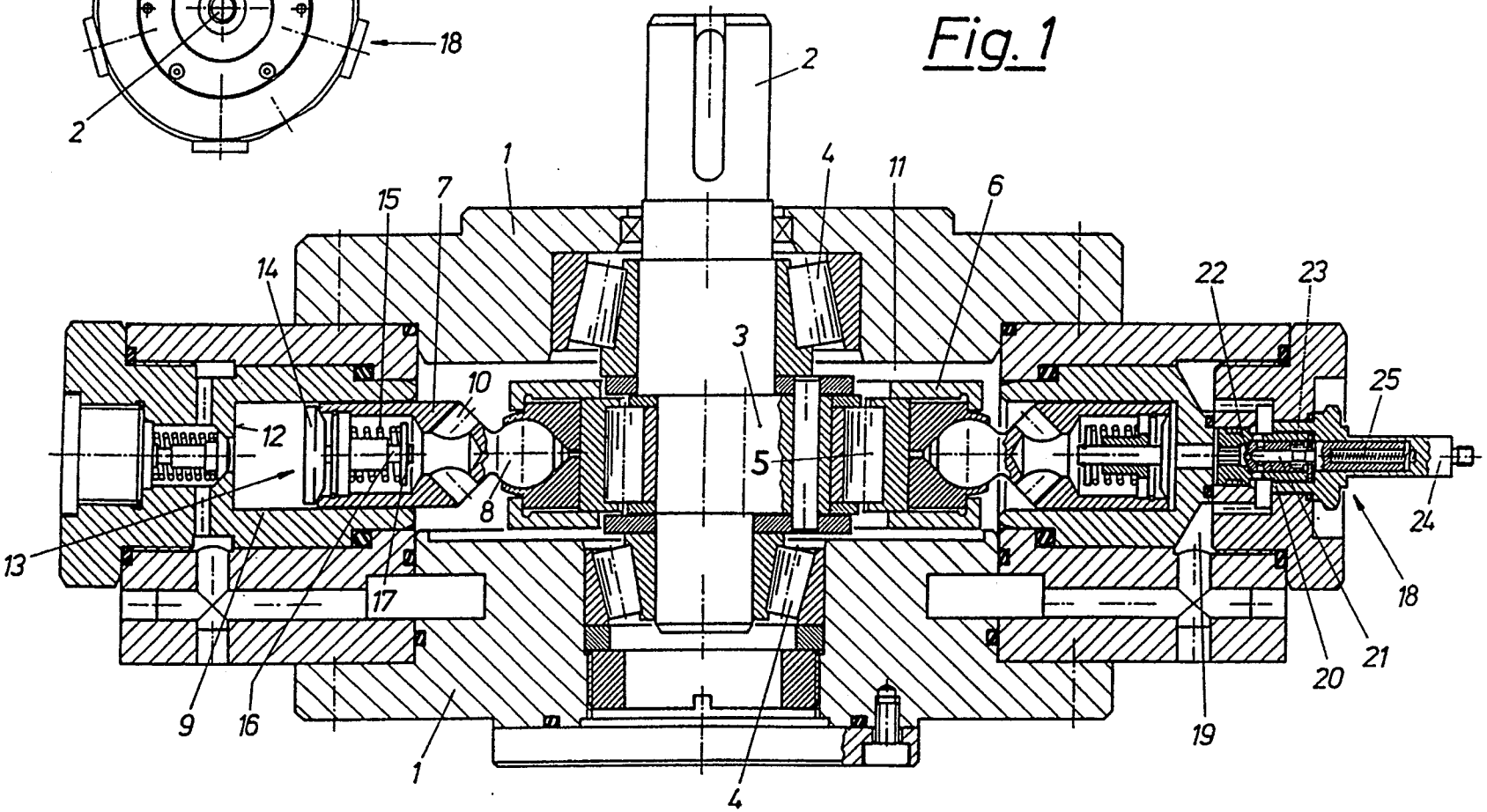

27
24
25
26
18
21
23
20
22
19
14
13
15
16
17
9
7
8
10

INDIVIDUAL CONTROLLABLE CYLINDER-PLUNGER ASSEMBLIES OF A RADIAL PISTON PUMP

This is a continuation of application Ser. No. 07/838,299, filed Mar. 23, 1992, now abandoned.

The invention refers to a radial piston pump with a plurality of radially arranged cylinder-plunger assemblies having suction valves and pressure-regulating valves, with their plunger being controlled by an eccentric disk which eccentrically circulates relative to a housing accommodating the cylinders.

Conventional pumps of this type have problems with regard to controllability of the flow rate. In order to solve this problem, mechanical control units are frequently used by which the eccentricity of the eccentric disk is varied for altering the stroke of the plunger.

Such units are of very complicated design. In addition, their use is problematic because the control of such radial piston pumps is usually digital while, on the other hand, the pumps display an analogous behavior. It is thus necessary to determine the position of the control unit, which corresponds to particular partial loads, and to reproduce it as accurately as possible. This in turn causes a problem because the positions of the control unit which correspond to the particular partial loads change with the feed pressure. There is also a further problem in that many applications of such radial piston pumps require a very fine gradation of the partial flow rates of e.g. in the range of 2 to 3% of the maximum flow rate.

This leads to another problem because most of the control units have a displacement path in the range of about 15 mm so that a gradation of the flow rate in increments of about 2% of the maximum flow rate leads to gradations of the displacement path of approximately 0.3 mm which have to be traced accordingly, resulting in correspondingly increased complexity.

It is an object of the invention to propose a radial piston pump of the above-stated type which is characterized by a simple design and is suitable for a direct digital operation for controlling the flow rate.

In accordance with the invention, this object is attained by providing a separately actuatable valve by which the space between the end faces of the cylinders and the pertaining plungers is connectable with a pressure manifold of the pump, with the plungers of the pump preferably having different diameter.

In this manner, it is possible to control the flow volume of the pump through opening and closing of the separately actuable valves. In a pump in which the cylinders or plungers at same stroke have different diameters, it is possible to obtain e.g. 48 different stages when utilizing seven different cylinders so as to attain gradations of the flow rate in the range of about 2%. The use of complicated position monitoring devices as required in conventional radial piston pumps provided with mechanical control units for affecting the eccentricity of the eccentric disk by which the plungers are controlled is eliminated, thus significantly simplifying the operation of the radial piston pump.

The connection of the interior of the respective cylinder with a pressure manifold through opening of the separately actuatable valve leads to the advantage that even though the respective cylinder contributes to the pulsation of the flow rate per second, this flow volume remains ineffective since after reaching the dead center of the cylinder at the end of the pressure stroke, it is sucked up again by the subsequent suction stroke. This is because the flow volume is continuously kept under pressure through the connection of the interior of the cylinder with the pressure manifold so that the suction valve of this cylinder cannot open. Therefore, the flow rate per second of the pump pulsates independently of the number of opened separately actuatable valves; however, the amplitude of this pulsation diminishes with increasing number of opened, valves.

A shut down of single cylinders would also be possible by continuously maintaining an open connection between the suction side of the pump and the pressure side of the plunger. However, in this case this cylinder would not contribute anything to the pressure build up in the pressure manifold, and a shut down of a greater number of cylinders results in correspondingly long pauses between single pressure strokes which pauses are usually undesired for the operation of devices arranged downstream of such pumps.

In accordance with a further feature of the invention, the separately actuatable valve of each cylinder-plunger assembly may be arranged in a pressure-regulating valve which has a hollow valve body and is provided with an opening facing the cylinder and being controlled by a displaceable control piston which is controllable independent from the pressure conditions in the associated cylinder.

These measures result in a simple design of the radial piston pump according to the invention. Moreover, it is possible to modify existing radial piston pumps in a relatively simple manner. It is only necessary to replace the existing pressure-regulating valve with a pressure-regulating valve modified in a manner as described.

The invention will now be described with reference to the drawings in which

Figure 2:
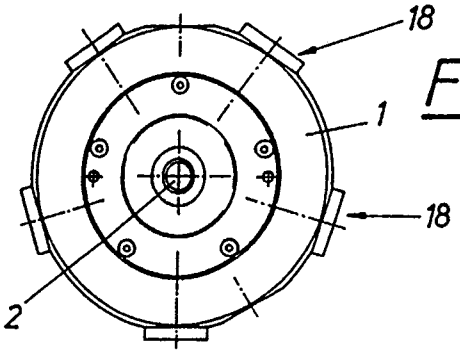
Figure 3:
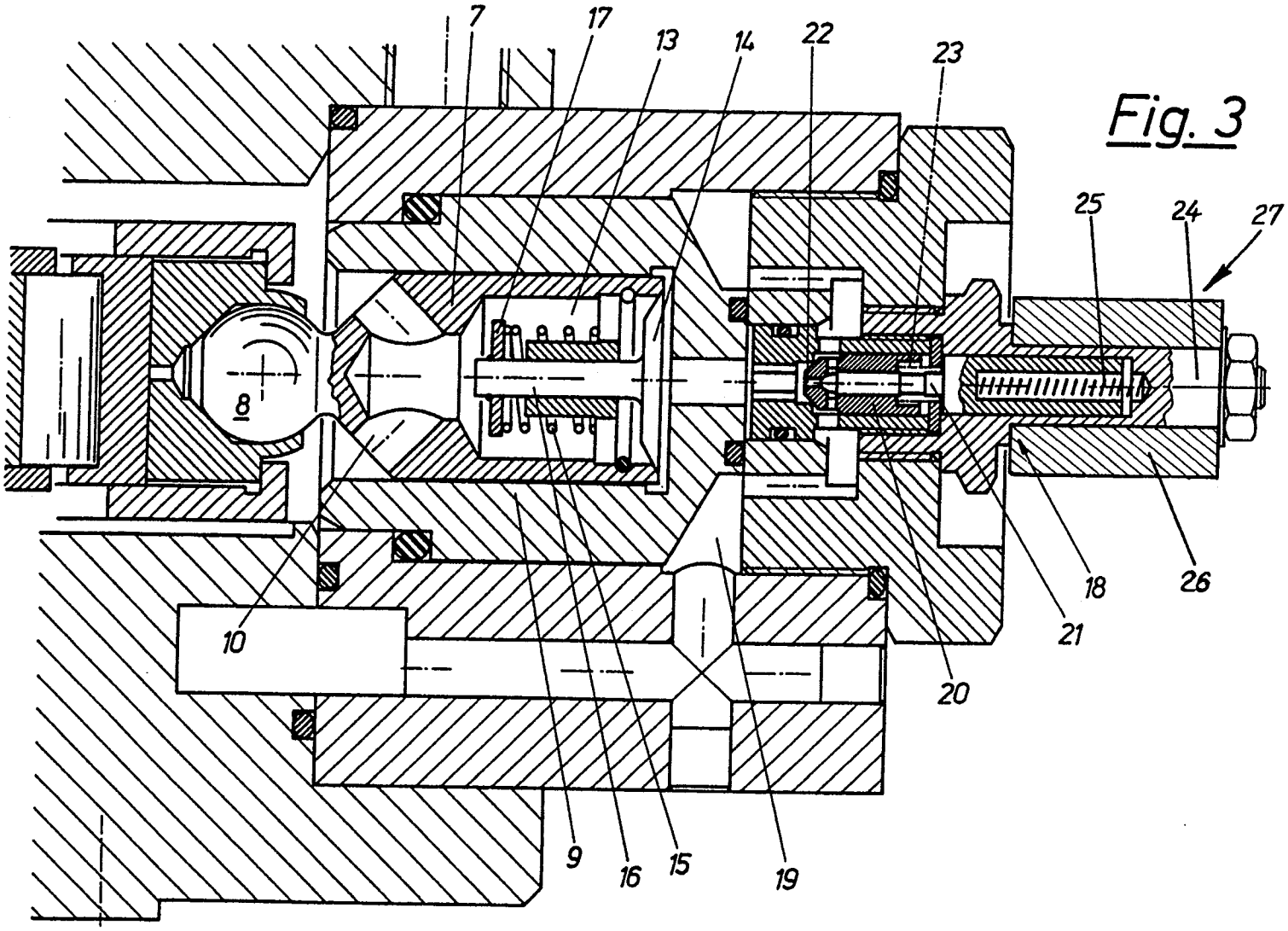
Figure 4:
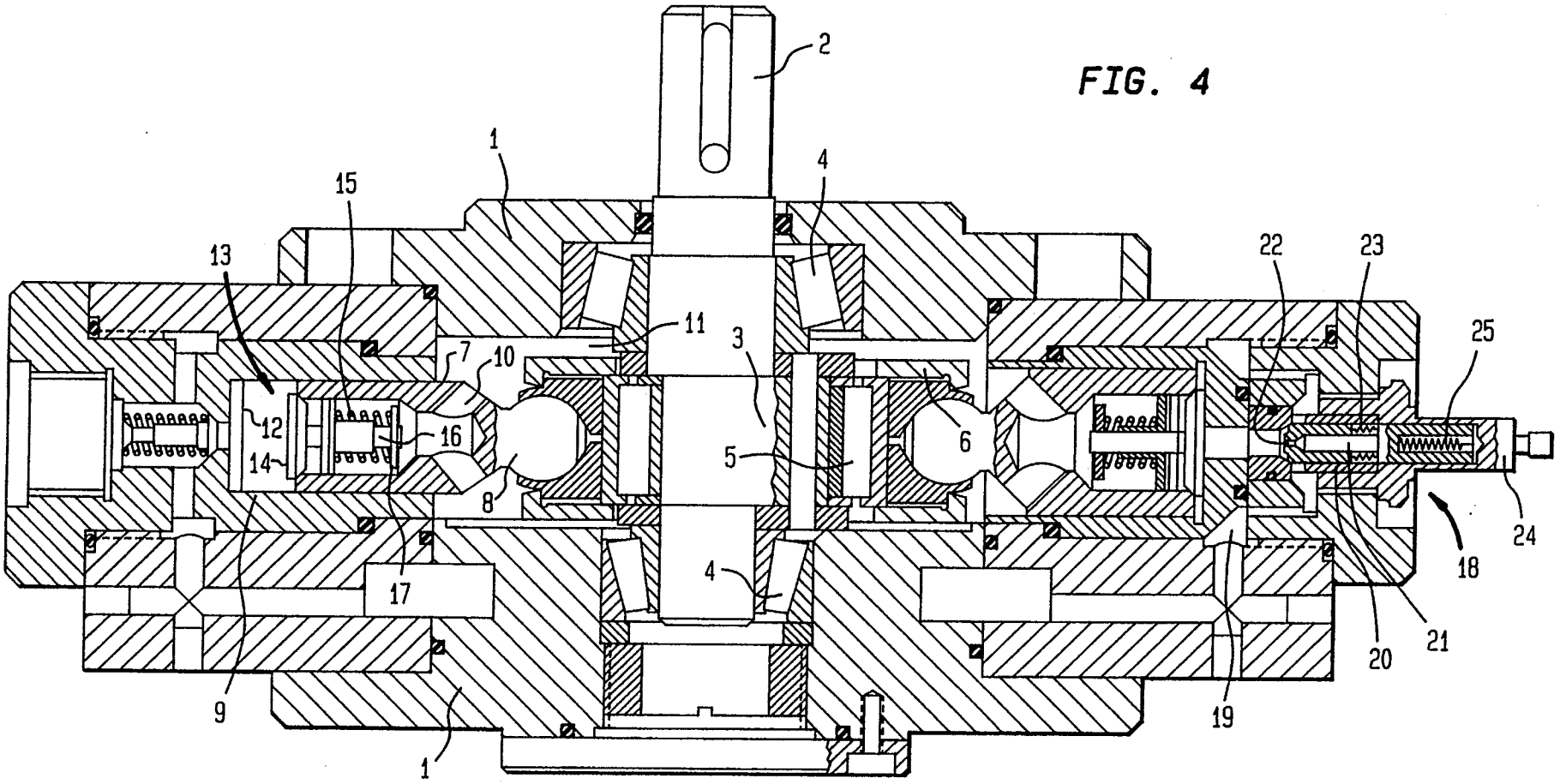

FIG. 1 shows a section through a radial piston pump according to the invention, FIG. 2 shows a front view of a radial piston pump according to the invention, FIG. 3 shows a section through a cylinder-plunger assembly of a radial piston pump according to the invention, on an enlarged scale, an FIG. 4 shows a sectional view of another embodiment of a radial piston pump according to the invention, illustrating plungers of cylinder-plunger assemblies with different diameters.

The radial piston pump has a housing 1 in which a shaft 2 is rotatably supported in angular roller bearings 4 and includes an eccentric disk 3 arranged eccentrically relative to the center axis of the shaft 2. Supported upon this eccentric disk 3 via a roller bearing 5 is a ring 6 which retains the plungers 7 via spherical heads 8.

The plungers 7 slide in cylinders 9 which are retained in the housing 1 and have an end section which faces the shaft 2 and includes apertures 10 connecting the interior of the plungers 7 with the interior space 11 of the sealed housing 1 which interior space 11 communicates with the suction side of the pump.

Mounted to the plunger 7 at the end face thereof which opposes the end face 12 of the cylinder 9 is a suction valve 13 which is designed as disk valve, with its valve head 14 being designed as mass element and biased by the spring 15 and the valve stem 16 and the spring plate 17 in the closing position.

The cylinder chambers are connectable with the pressure manifolds 19 via pressure-regulating valves 18 arranged in the end walls of the cylinders 9.

The pressure valves 18 are each controllable by a generally designated by reference numeral 27 and including a core 24 and a magnet coil 26, The pressure valve 18 has a hollow valve body 20 in which a control piston 21 is slidably guided for controlling the aperture 22 of the valve body 20.

The valve body 20 is biased in closing position by a relatively weak spring 23. The control piston 21 is guided within the core 24 of the magnet and biased by means of a relatively strong spring 25 in the closing position.

As long as the magnet is not excited, the valve body 20 is retained in closing position by both springs 23, 25, with a penetration of pressure fluid into the interior of the valve body 20 being prevented.

During pressure stroke of the plunger 7, the valve body 20 clears its seat and pressure fluid flows in the pressure manifolds 19. When reaching the dead center at the end of the pressure stroke, the pressure valve 18 closes. In case the magnet is excited, the control piston 21 is withdrawn to thereby open the connection between the pressure manifold 19 and the interior of the cylinders 9.

Thus, at operation of the pump, the flow rate of the one cylinder or piston whose pressure valve 18 is opened is merely discharged and returned during the successive suction stroke from the pressure manifold 19 so as to remain ineffective. An opening of the suction valve 13 is prevented by the pressure acting from the pressure manifold upon the valve head 14 of the suction valve 13 so that no leakage can occur via the suction valve 13.

The cylinders 9 or plungers 7, respectively, of the pump have different diameter, as shown by way of example in FIG. 4. Therefore, the flow rate of the pump can be varied through connecting and disconnecting one or more cylinders 9 and through opening of the connection between the interior of the cylinders and the pressure manifold 19. This means e.g. with reference to the illustrated example with five cylinders 9 (FIG. 2) that 24 different power stages are obtained, or 48 power stages in case of seven cylinders. Through suitable selection of the diameters of individual cylinders and through respective operation of their control pistons 21 for making and breaking a connection between the pressure manifold 19 and the interior of the cylinders 9, gradations of the flow rate of about 2% of reaching the full power of the pump are possible in case of seven cylinders.

A shutting down of cylinders or an elimination of their effectiveness through opening the pressure valve 18 is advantageous also because the pulsation of the flow volume remains constant as in case of full pump capacity i.e. when all pressure valves 18 are closed. Only the amplitude of the pulsation changes and becomes smaller with an increase of opened pressure valves 18. Therefore, the use of such pumps is facilitated for applications in which the flow rate of the pump is digitally controlled because in this case only the corresponding pressure valves 18 need to be selected. Thus, a very sensitive power control is attained when utilizing a respectively great number of cylinders.

I claim:

1. A radial piston pump of the type having a plurality of radially arranged cylinder-plunger assemblies, each of which comprising:

a cylinder;

a plunger movable in said cylinder;

actuating means operatively connected to said plunger for controlling movement of said plunger;

a suction valve communicating with said cylinder for admitting fluid from a suction manifold into said cylinder during suction stroke of said plunger; and a pressure valve communicating with said cylinder for delivering fluid from said cylinder into a discharge manifold via a first fluid passageway during the pressure stroke of said plunger, said pressure valve accommodating a separately actuatable control valve for selectively opening a second fluid passageway between said cylinder and the discharge manifold.

2. The radial piston pump defined in claim 1, and further comprising a housing for accommodating said cylinder, said actuating means including an eccentric disk which eccentrically circulates relative to said housing.

3. The radial piston pump defined in claim 1 wherein said pressure valve has a hollow valve body and is provided with an opening facing said cylinder and controlled by a slidably guided control piston which is controllable in said cylinder independent from pressure conditions.

4. The radial piston pump defined in claim 1 wherein the plungers of the cylinder-plunger assemblies have different diameters.

5. The radial piston pump defined in claim 1, and further comprising a magnet operatively connected to said pressure valve for controlling operation thereof.

6. A radial piston pump including a plurality of radially arranged cylinder-plunger assemblies, each having a suction valve and a pressure valve, with the plunger of the cylinder-plunger assemblies being controlled by an eccentric disk which eccentrically circulates relative to a housing accommodating the cylinders, wherein the cylinder (9) of each cylinder-plunger assembly has an end face (12) which defines with the plunger (7) a space selectively connectable with a pressure manifold (19) of the pump via a separately actuatable valve (21, 22) for allowing variable control of the flow rate of the pump, wherein the separately actuatable valve (21, 22) is arranged in the pressure valve (18) which has a hollow valve body (20) and is provided with an opening (22) facing the cylinder (9) and controlled by a slidably guided control piston (21) which is controllable in the pertaining cylinder (9) independent from pressure conditions.

7. The radial piston pump defined in claim 6 wherein the plungers of the cylinder-plunger assemblies have different diameters.

8. The radial piston pump defined in claim 6, and further comprising a magnet operatively connected to said pressure valve for controlling operation thereof.

* * * * *